United States Patent [19]

Vanderwal, Jr.

[11] 4,035,959

[45] July 19, 1977

[54] CAM OPERATED AUTOMATIC CONTROL FOR A HONING MACHINE

[75] Inventor: Frank E. Vanderwal, Jr., St. Louis County, Mo.

[73] Assignee: Sunnen Products Company, St. Louis, Mo.

[21] Appl. No.: 724,586

[22] Filed: Sept. 20, 1976

[51] Int. Cl.[2] ..... B24B 5/08; B24B 51/00

[52] U.S. Cl. ..... 51/34 K; 51/165.89; 51/331

[58] Field of Search ..... 51/2 P, 2 C, 34 R, 34 C, 51/165.89, 331, 347–350

[56] References Cited

U.S. PATENT DOCUMENTS

| | | | |
|---|---|---|---|
| 2,092,721 | 9/1937 | Arter | 51/165.89 X |
| 2,252,176 | 8/1941 | Harris | 51/34 K |
| 2,781,616 | 2/1957 | Estabrook | 51/347 X |

*Primary Examiner*—Al Lawrence Smith
*Assistant Examiner*—Nicholas P. Godici
*Attorney, Agent, or Firm*—Charles B. Haverstock

[57] ABSTRACT

An apparatus for automatically controlling the operations of a machine tool such as a honing machine or the like, which apparatus sets in motion apparatus which controls and maintains the operating cycle of the machine automatically and without requiring further operator attention once the machine cycle is started and until the operation has been completed whereupon the machine operation is automatically terminated. The subject apparatus includes control features which relieve the operator from maintaining pressure on a foot pedal or other machine operator member, it relieves the operator from making a decision as to when a machining or honing operation has been completed, it enables an operator to make more uniformly consistent parts, it minimizes the operator attention required to repetitively hone or otherwise produce similar parts, and the subject control apparatus may include features by which the rate at which the work engaging members are brought into operative engagement with the work is predeterminately controlled depending upon the condition of the work including the smoothness of the work surface and the characteristics of the work members. The present control apparatus is especially adaptable for use with automatic shut-off apparatus such as that disclosed in Sunnen U.S. Pat. No. 3,868,007, issued Feb. 25, 1975.

12 Claims, 5 Drawing Figures

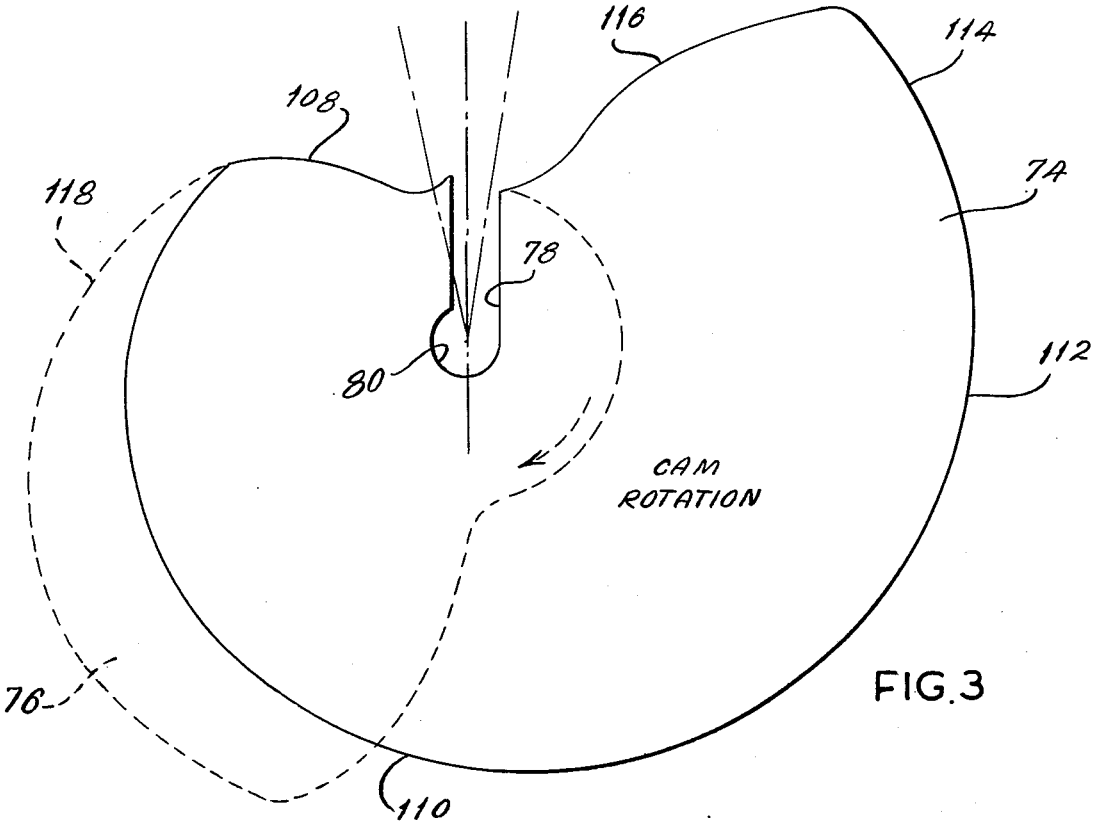
FIG.3
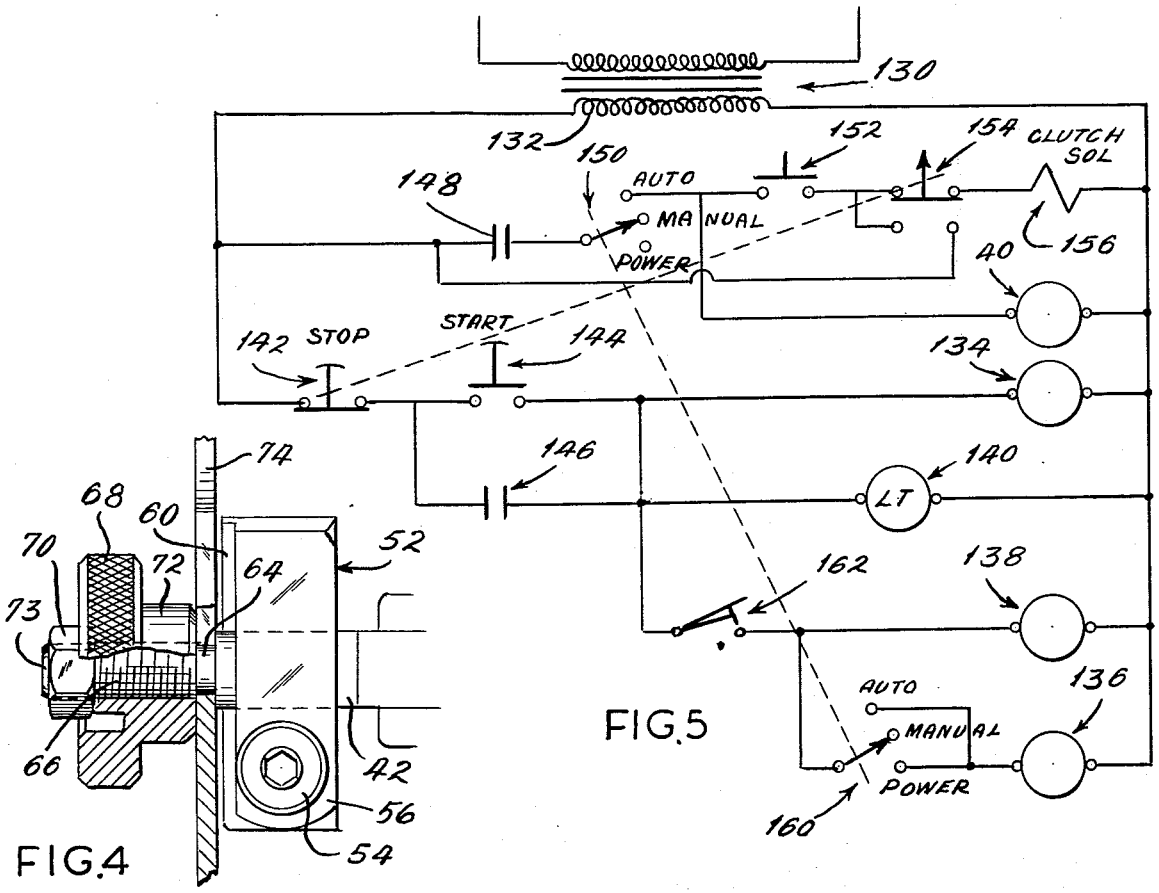
FIG.5
FIG.4

CAM OPERATED AUTOMATIC CONTROL FOR A HONING MACHINE

Many machine tools and other devices including honing machines are in use and many require that the operator actuate a foot or hand pedal and maintain pressure on the pedal while in its actuated position so long as a particular operation is in process or until some final result has been achieved, at which time the operator member is released or retracted by the operator so that the working members are released from the work and the work removed and replaced by other work. Pedal operated machines for the most part require relatively constant operator attention, they require that the operator be skilled so that he will know when an operation has been completed and should be stopped, and in machine operations where operator attention is constantly required the products produced will vary from operator to operator and even for the same operator, they will vary with the kind of operation being performed, and they will vary depending on the amount of pressure of control required by the operator. All of these and other disadvantages of known devices tend to cause them to produce non-uniform products and waste, they require operators of considerable skill, training and experience, they require more of the operation's time and attention and they adversely affect efficiency. Also, pedal operations frequently cause damage to the work and to the working members especially if the rate at which the working members are brought into engagement with the work does not take into account the characteristics of the members involved. These and other shortcomings and disadvantages of known devices are overcome by the present construction.

Honing and like machines, and especially manually operated honing machines in use at this time, for the most part are pedal operated devices which have many of the undesirable characteristics described above. The present invention is designed to overcome these and other disadvantages and at the same time to relieve the operator of many of the chores normally associated with pedal operated machines, including the chore of having to constantly pay attention to the operations being performed. It is also important to enable the operator to commence an operation which will proceed to some final desired result automatically, without his attention, and will terminate itself automatically when the operation has been completed at which time the operator will know to replace the part that has been completed with another, and to make possible a better condition for bringing the work engaging members into engagement with the work. The present invention also makes possible the production of more uniform parts and substantially reduces the attention required by the operator so that the operator can do other things which increase his efficiency and output. Honing and like operations which require that a mandrel rotate in a cylindrical bore are the type of operations that in the past have required constant operator attention and considerable skill and training because of the fragile nature of the members involved and the high degree of precision that is usually required. The present invention enables the production of more accurate and uniform parts. Machines of the type on which the subject improvements can be incorporated are disclosed in Sunnen U.S. Pat. Nos. 2,349,526, issued May 23, 1944 and 3,152,424, issued Oct. 13, 1964.

It is therefore a principal object of the present invention to provide means for producing more uniform parts in a machine operation.

Another object is to relieve operators of machine tools such as a honing machines of certain of the operational steps which in the past have affected the quality and uniformity of the finished products.

Another object is to provide means to predeterminately control the rate at which a working member is brought into engagement with work taking into account the physical and operational characteristics of each.

Another object is to use cam means to control the bringing into engagement of a work member and work.

Another object is to make honing and like machines more versatile, easier to set up to perform a desired honing operation, and simpler and less time consuming for the operator.

Another object is to make honing and like machines easier and safer to operate.

Another object is to provide means to maintain a machine tool such as a honing machine in an operating condition until a predetermined amount of work has been accomplished and to then automatically shut off the machine.

Another object is to automatically maintain a machine in an operating condition independently of any action by the operator and until a desired amount of work has been performed.

Another object is to increase the versatility and flexibility of honing and like machines.

Another object is to enable machine tools such as honing machines to be operated using automatically controlled cycles or to be used under manual controls if desired.

These and other objects and advantages of the present invention will become apparent after considering the following detailed description in conjunction with the accompanying drawings wherein:

FIG. 3 is a side view of a typical cam for use on the subject device, one form of cam being shown in solid outline and another in dotted outline;

FIG. 4 is an enlarged fragmentary cross-sectional view taken on line 4—4 of FIG. 2; and, FIG. 5 is a simplified schematic circuit diagram for the subject apparatus.

Figure 1:
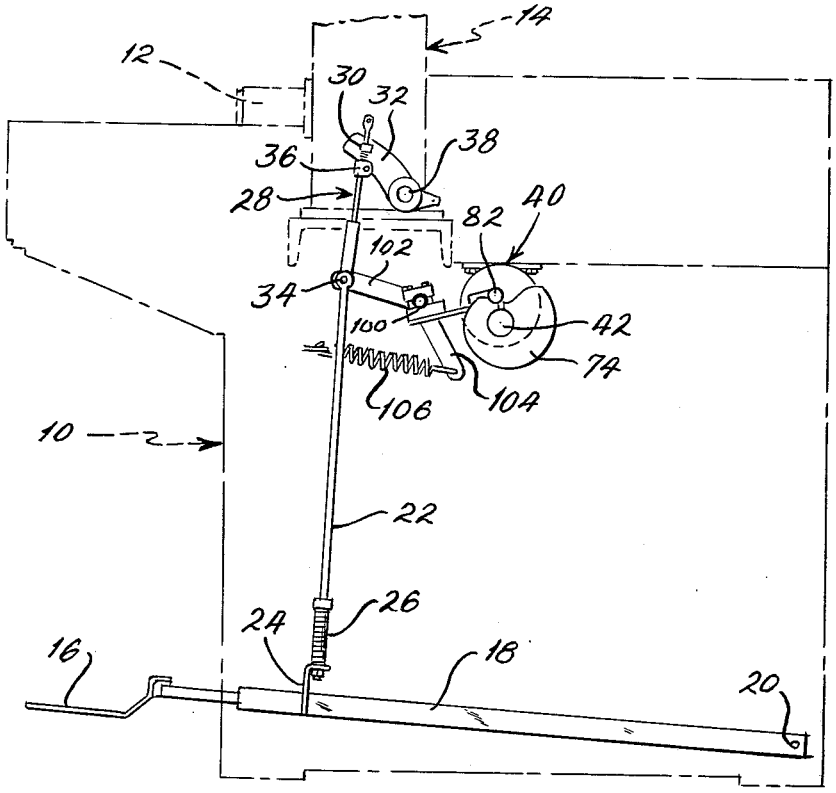
FIG. 1 is a side view, partly diagrametic of a machine tool such as a honing machine equipped with the subject automatic control features.

Referring to the drawing more particularly by reference numbers, number 10 identifies a machine tool such as a honing machine. The machine 10 can be of a known construction such as disclosed in the above-mentioned Sunnen Patents, and includes a rotatable mandrel which is mounted on the machine on a device such as adaptor 12. The mandrel includes abrasive members which engage the member being honed. The honing machine 10 also includes an automatic shut-off feature 14 similar to that disclosed in Sunnen U.S. Pat. No. 3,868,007. The automatic shut-off is mounted on the machine in the position shown in FIG. 1 and is used in conjunction with the present improvements to improve the operating characteristics of the machine and to relieve the operator of many of the duties normally associated with the operation of such a machine. One of these duties is the duty of depressing a foot pedal such as the foot pedal 16 and maintaining the foot pedal depressed until the honing operation is completed. With the present construction operating in the automatic mode, it is not required of the operator to even depress the foot pedal although the manual mode of operation is an optional possibility and can be used if desired.

As explained in U.S. Pat. No. 3,868,007 when the operator depresses the foot pedal 16 means in the structure 14 are placed in an operating condition which cause the honing stones of a mandrel to move radially outwardly into engagement with a work surface on a workpiece so that the honing stones will move into engagement with and rotate on the work surface thereby causing a honing operation to take place. As stated, with the known devices the operator must depress the pedal 16 in order to establish the conditions necessary for the stones to move outwardly into engagement with the work, and the work cycle proceeds manually or automatically even though the operator may take his foot off the foot pedal 16 until some desired final condition is reached as determined by operation of means in the structure 14. With the known devices depression of the foot pedal 16 immediately moves the stones outwardly into engagement with the work and the rate of stone movement is directly proporational to the rate of foot pedal depression which may vary and does not take into account the roughness, hardness and other characteristics of the workpiece or the fragile characteristics of the particular honing stones selected to perform the work. Furthermore, as noted, the operator in the past had to depress the foot pedal in order to establish the conditions necessary to move the working members into engagement with the work but no known means were provided for controlling these conditions. Furthermore, there are no means in the known constructions to relieve the operator of the necessity of depressing the foot pedal, there are no means for selecting the feedup rate of the stones as they move into engagement with the work, and with the known machines there is not the opportunity to select between a fully automatic and a manual operation.

Referring to FIG. 1 of the drawing, the foot pedal 16 is shown connected to a rocker assembly 18 which is pivoted at 20 to the base of the honing machine. The assembly 18 is connected by means of a rod 22, a bracket 24 and biasing means 26 to another rod assembly 28 which is in turn connected through other spring biasing means 30 to a rocker arm 32. When the pedal 16 is depressed the rod 22 is moved downwardly and the rod assembly 28 also moves downwardly being pivotally connected to the rod assembly 22 at 34. This causes the biasing means 30 to move downwardly against a sidewardly extending portion 36 on the rocker arm 32 and causes the rocker arm 32 and shaft 38 on which the arm is mounted to move counterclockwise. As explained in detail in Sunnen U.S. Pat. No. 3,868,007, this causes certain members in the assembly 14 to move into a latched condition which is a condition that maintains the honing machine in an operative honing condition. The latched or honing condition operates mean that cause the stones on the honing mandrel (not shown) to move radially outwardly into engagement with the work, and during rotation of the mandrel, the honing operation takes place. This operation continues until a predetermined amount of honing has occurred at which time two other members located in the assembly 14 move past each other and out of engagement to delatch the means previously latched to cause the honing machine operation to stop. The same thing also takes place when the honing machine is equipped with the present improved construction. Note that with the patented construction, the operator must depress the pedal 16 which then latches the assembly 14 in a honing condition and the honing proceeds until the desired final honed condition has been reached. However, with the existing equipment there is no way to control the rate at which the stones are moved radially outwardly into engagement with the work and it is still necessary for the operator to depress the foot pedal 16 in order to establish the conditions necessary to produce a honing operation. With the present improvement construction, however, these requirements no longer exist and it is only necessary with the improved construction for the operator to press a switch which automatically sets in motion a honing operation and causes the stones to move into engagement with the work at some desired controlled rate which can be preset or preselected depending upon the conditions described above, namely the condition of the surface to be honed and the type of honing stones to be used.

Figure 2:
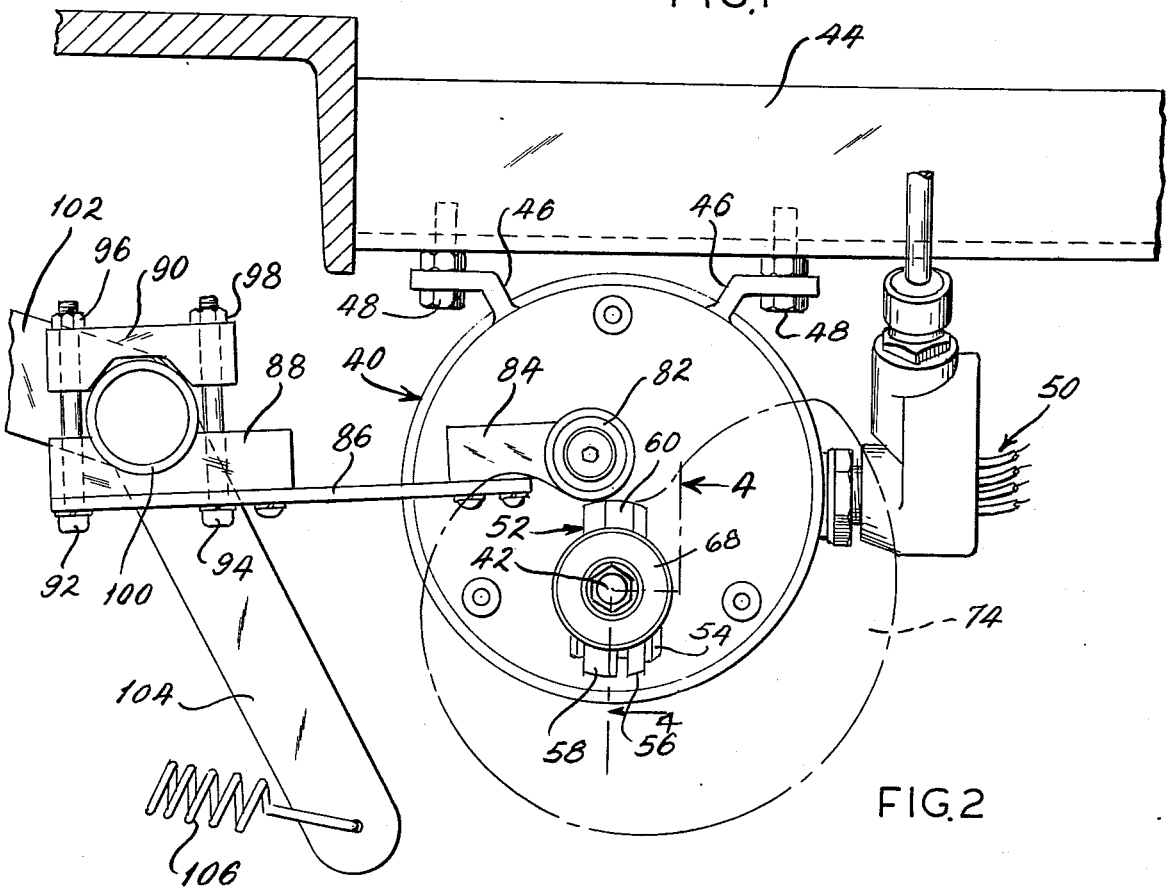
FIG. 2 is an enlarged fragmentary view of the more important components of the subject control apparatus.

The subject improved construction includes a motor driven unit 40 which may include a gear reducer portion which has an output drive shaft 42. The motor unit 40 is mounted on the frame 44 of the honing machine by means of spaced leg portions 46 and associated bolts 48. Power supply leads 50 are connected to the motor unit 40 and to switch means on the honing machine (not shown). The motor shaft 42 has clamped to it as shown in FIG. 4 a clamp assembly 52 which is clamped thereon in fixed position by means of threaded member 54 which extends through an opening in one of two spaced clamp portions 56 and 58 and is threadedly engaged with the other. The member 54 is usually set at the factory. The clamp assembly 52 also has an outwardly extending land 60 formed thereon which extends from the side thereof as shown in FIGS. 2 and 4. The land 60 is off set on the clamp assembly 52 relative to the axes of the shaft 42 so that the land 60 can be used to accurately locate a cam which is to be installed adjacent to the clamp 52. The cam will be described later. The land 60 prevents the cam from being installed backwards.

The motor shaft 42 has a reduced diameter portion 64 which extends from adjacent to the clamp assembly 52 as clearly shown in FIG. 4, and the free end portion of the shaft 42, which is the portion that is beyond the reduced diameter portion 64, is threaded at 66 to receive a knurled rotatable knob member 68 and a lock nut 70.

The clamp assembly 52 is locked onto the shaft 42 at the location shown in FIG. 4 with the land 60 positioned in a vertical direction as shown in FIG. 2. The clamp assembly 52 is mounted adjacent to the reduced diameter shaft portion 64 so that when the lock nut 70 is backed off and the knurled knob 68 are also backed off, a space is provided between a small diameter portion 72 of the knob 68 and the clamp assembly 52 which is wide enough to receive a cam 74 (or 76). A set screw 73 operating within lock nut 70 is tightened against the end of the motor shaft 42 securing both the set screw 73 and the lock nut 70 to the shaft 42 such that the knob 68 may not inadvertently be removed from the threaded shaft portion 66. The cam 74 is a slow cycle cam for reasons which will be explained later and the cam 76 is a fast cycle cam.

FIG. 3 shows the details of the slow cycle cam 74 which has a slot 78 formed extending into it from one side that terminates in a round opening 80. The slot 78 communicates with the opening 80 but is off set somewhat relative to the center thereof. The cam 74 is installed on the machine by moving the slot 78 onto the reduced diameter portion 64 of the shaft 42 when the knurled member 68 is backed off, and when so positioned the slot 78 cooperates with the land 60 on the clamp assembly 52, which as explained above, is also off set somewhat relative to the axis of the motor shaft 42. Therefore the round opening 80 can be moved sidewardly somewhat to accommodate the shaft 42 at this time. When the cam has been so positioned the knurled knob 68 is rotated to move it toward the clamp assembly 52 to clamp the cam 74 between the knob portion 72 and the clamp assembly 52. The cam 74 (or 76) is important to the operation of the present device because it controls the rate at which the work engaging members such as the stones on a honing or like machine move into engagement with the work. If the work surface to be honed is initially in a relatively rough condition then it is usually desirable to bring the work engaging members into engagement therewith relatively slowly in order to prevent damage to the working members and to the work surface. On the other hand, if the work engaging surface is relatively smooth and if relatively little honing is to be done to it then it may be desirable to bring the work engaging members into engagement with the work more rapidly in order to reduce the total honing time and increase the operating efficiency. In cases where the work engaging members are to be brought into engagement with the work more rapidly, it is expected that the cam such as the cam 76 will be used instead of the cam 74.

Referring again to FIGS. 1 and 2 the cam 74 is shown engaged by a follower roller 82 mounted on a member 84. The member 84 is attached to one end of an arm 86 that has its opposite end connected to one member 88 of another clamp assembly that includes the clamp members 88 and 90 and threaded connector members 92 and 94 and associated nuts 96 and 98 respectively. The clamp members 88 and 90 are shaped to be clamped to a clutch tube 100 which is journaled to the honing machine and connected to an arm member 102. The arm 102 has its opposite end pivotally connected by means 34 to the rod assemblies 22 and 28. The clutch tube 100 is also connected to another arm 104 which has a biasing spring 106 connected adjacent to its opposite end, which spring is anchored to the frame of the honing machine. The purpose of the spring 106 and the arm 104 is to bias the arm 86 in a direction to maintain the cam follower 82 engaged with the surface of the cam 74 (or 76).

The arm 102 rotates with the clutch tube 100 in response to rotation of the cam 74 and the follower action of the cam follower 82. The movements of the arm 102 operate through the rod 28 to produce movements of the crank arm 32 in a manner similar to when the foot pedal 16 is depressed. If the foot pedal were depressed, however, the arm 102 would still move and in that case would lift the follower roller 82 off of the cam surface in opposition to the force of the spring 106 enabling the honing machine to be operated by the foot pedal in the usual way independently of the cam. The spring 106 therefore in addition to maintaining the follower 82 on the cam 74 raises the foot pedal 16 when the operator removes his foot from the pedal 16.

The shape of the cam is important to the operation of the present device. In FIGS. 1 and 2 the cam 74 is shown in its initial or inactive position prior to commencement of an automatic honing operation. During each honing operation under control of the cam, regardless of the length of the operation, the cam 74 makes one complete rotation and stops. Referring to FIGS. 1, 2 and 3 the cam 74 (or 76) operates by rotating in a clockwise direction whereby the follower roller 82 initially moves up the cam portion 108 (FIG. 3) which for the cam 74 produces a relatively fast outward movement of the follower 82 and hence a relatively fast counterclockwise motion of the crank arm 32. The fast initial outward movement of the follower 82 causes the honing stones to initially move radially outwardly at a relatively rapid rate toward the work surface.

Thereafter, as the cam 74 continues to rotate clockwise the follower 82 moves along a relatively long and gradually increasing diameter portion 110 of the cam 74, and during this period the working members or stones move slowly into operative work engagement with the surface being honed. By the time the cam 74 has rotated to the point 112 (FIG. 3) on the cam surface, the work engaging members will be fully engaged under pressure with the work and the automatic shutoff mechanism 14 will be latched to maintain the operative engagement until the desired amount of honing has taken place as determined by other mechanisms in the 14 and in the honing machine. The portion 114 of the cam surface is circular and is of the same diameter as at 112 and no additional operations take place during this time insofar as the function of the cam is concerned. However, during this portion of the cycle it is not possible for the work engaging members to become disengaged from the work. After the follower 82 has moved over the cylindrical cam portion 114 it moves onto the cam portion 116 and moves inwardly under the action of the spring 106 to restore it to its inoperative position which is the position shown in FIGS. 1 and 2. The cam will stop rotating after it has made one complete rotation under control of means in the controls for the drive unit 40. The follower 82 will remain in its inactive position and the honing operation which has been set in motion will continue until a desired final size of the workpiece has been reached when the operation will automatically stop under control of means in the assembly 14. It is important to note that only one rotation of the cam 74 (or 76) is required to initiate a honing operation which may last well beyond the time required for the cam to make its rotation.

The cam 76 is a fast cycle cam as compared to the cam 74 even though the time to make one complete rotation of the cam 76 is the same as for the cam 74. The reason the cam 76 is a fast cycle cam is because it is designed to take less time for the cam follower 82 to cause the honing stones to move outwardly into engagement with the work. This is because the follower 82 moves on the cam portion 118 of the cam 76 which produces a much more rapid outward movement of the stones. The shape of the cam 76 also enables the follower to move to its inner inoperative position after only about a half cycle of cam rotation. The fast cycle cam 76 therefore is able to establish a full honing condition in less time than can the cam 74. This has advantages for certain applications especially where it is desired to hone a relatively large number of surfaces in minimum time and where the surfaces to be honed are relatively smooth to begin with so that not much honing need be done, and where there is not as great a chance for breakage or damage by having the stones move into engagement with the work surface at a fairly rapid rate. In such cases it may also be desirable to hone the members more rapidly or for a shorter time and this is possible when using a fast cycle cam. For example the total honing cycle for such parts may not be substantially longer than the time required for the cam 76 to make its complete rotation. In fact the honing time may actually be less than the time required for the cam to rotate in which case it may be possible to hone a different member during the time it takes for the cam 76 to make one rotation. Only one part can be honed during any one revolution of the cam 76, but during the remaining portion of the cam rotation after the follower 82 has moved past the cam portion 118, the honed part can be removed from honing position, gaged, and replaced by another part to be honed.

The fast cycle cam 76 is installed on the motor shaft 42 between the clamp assembly 52 and the knob member 68 in the same manner as the cam 74, and as explained, because of the construction of the clamp 52 including the land 60 thereon, it is a simple matter to accurately replace one cam with another. It is also contemplated to use other intermediate size cams to cover a full range of rise times (times required for the stones to move into engagement with the work) although in practice it has been found that two cams of the types described as cams 74 and 76 are usually all that is necessary to cover most situations.

The motor drive unit 40 may be of conventional construction including an electric motor coupled to a suitable gear reducer whose output shaft 42 is positioned as shown. The drive unit 40 as well as other components of the honing machine are controlled by switch means conveniently located for access to the operator, and when the switch means are actuated the drive unit 40 will be energized to cause the selected cam to make one complete rotation and stop. Means for accomplishing this are well known in the art and may include clutch means (not shown) for disengaging the motor means from the gear reducer means, solenoid means, or cam operated limit switch means.

FIG. 5 shows a simplified circuit diagram using solenoid 156 to release a single revolution clutch operating between the continuously rotating motor 40 and the output shaft 42. In the simplified control circuit of FIG. 5, power is supplied through transformer 130 which has its secondary winding 132 connected across a plurality of parallel circuits including circuits for operating a coolant system magnetic motor starter 134, with machine and coolant "on" indicator light 140, spindle magnetic motor starter 138 and stroking magnetic motor starter 136. In addition, the circuit includes a normally closed stop push button switch 142 and a normally open start push button switch 144. When the start push button switch 144 is depressed, circuits are established for energizing the coolant system motor starter 134 and indicator light 140. As soon as the motor starter 134 commences to operate it closes one of its normally open hold switch contacts 146 to establish a hold circuit to maintain the elements 134 and 140 energized.

The circuit has another portion which includes another normally open contact 148 which is closed when motor starter 34 is energized in series with a three position rotary selector switch 150 shown in the position marked "manual." The same circuit portion includes another normally open push button switch 152, a two position push switch 154 ganged together with stop switch 142 shown in its normal position, and a clutch solenoid coil 156 which, when actuated, energizes clutch means associated with motor unit 40 which causes the cam 74 (or 76) to rotate. This circuit portion also has a connection made between the contact of rotary selector switch 150 marked "Auto " and the motor unit 40 to energize the motor 40. Another alternate circuit is provided to energize the motor unit 40 through the normally open contacts of the switch 154 and the push button switch 152 when operated simultaneously. Coincident with the operation of the switch 154, the stop switch 142 is operated causing interruption of the circuit to all other portions of the circuit that are desired to be inoperative during the operation of motor unit 40 under these circumstances. This feature is provided for safety reasons but has no particular significance as far as the present invention is concerned.

The circuit of the stroking motor starter 136 includes another three position rotary selector switch 160 which is ganged to operate with the three position switch 150. The circuit to the stroking motor starter 136 is completed when the switch 160 is in the position marked "Auto" and "Power" and is interrupted when the switch 160 is in the position marked "Manual." The circuit of the spindle motor starter 138 and the stroking motor starter 136 are dependent for their energization on another limit switch 162 which is closed by mechanism within the automatic shut-off assembly 14 as a result of the motion of the rocker arm 32.

The ganged together rotary switches 150 and 160 have three operating positions as aforesaid. In the "Auto" position and with the mandrel rotating the machine will feed up the stones or other work engaging members into engagement with the work under control of the cam 74 (or 76), and while the stones are rotating will also stroke the stones back and forth in the usual manner and until the desired final size has been reached whereupon the honing operation will stop under control of the means 14. In the manual switch setting position there will be no automatic feed up of the stones but the machine can still be operated by depressing the foot pedal. In the manual setting position no stroking motion will take place. In the third or "power" setting position the operation will be manual except that in this position power will be available to produce a stroking motion. In all three setting positions power will be supplied to the pump motor 134 to circulate coolant, to energize indicator light 140 and to energize the spindle motor 138 which is the motor that rotates the mandrel on which the honing stones are located.

Thus, there has been shown and described novel means for making a honing or like machine automatically operable to perform a predetermined honing operation taking into account the characteristics of the work and the working members, which means fulfill all of the objects and advantages sought therefor. It will be apparent to those skilled in the art, however, that many variations and changes of the present construction can be made without changing the nature or scope of the invention. All such changes, modifications, variations, and other uses and applications of the subject device which do not depart therefrom are deemed to be covered by the present invention which is limited only by the claims which follow.

What is claimed is:

1. In a honing machine having a mandrel with a radially movable work engaging member mounted thereon and means for radially moving said work engaging member into engagement with a cylindrical work surface to be honed, the improvement comprising cooperatively engageable cam and cam follower members one of which is operatively connected to the work engaging member for controlling the rate of radial movement thereof into engagement with the cylindrical work surface, means responsive to a predetermined relationship between the cam and cam follower members to establish a condition to maintain the work engaging member engaged with the work surface independently of the cam and cam follower members, and means responsive to a predetermined honed condition of the work surface to automtically terminate the honing operation, said last named means including means to enable the work engaging member to move out of engagement with the work surface.

2. In the honing machine of claim 1 motor means operatively connected to rotate the cam member through an operating cycle, said cam member having a first surface portion engageable by the cam follower member during rotation thereof to move the cam follower member and the work engaging member operatively connected thereto into operative engagement with the work surface at a rate determined by the contour of said first cam surface portion, said cam member having a second surface portion engageable by the cam follower member during a part of the operating cycle after the cam follower member has engaged the first cam surface portion, the contour of said second cam surface portion enabling the work engaging member to move out of engagement with the work surface when the predetermined honed condition of the work surface has been reached.

3. In the honing machine of claim 2, means associated with the motor means to produce one rotation of the cam member for each operating cycle.

4. In the honing machine of claim 2, means to mount the cam member on the motor means in a predetermined initial condition.

5. In the honing machine of claim 1, manual control means operable to move the work engaging member into engagement with a work surface, said manual control means including means for moving the cam follower member out of engagement with the cam member.

6. In the honing machine of claim 5, said manual control means include a pedal and means operatively connecting said pedal to the camm follower member.

7. In a honing machine having a mandrel with a radially movable work engaging member mounted thereon, means to rotate the mandrel during a honing operation, means to stroke the mandrel axially relative to a workpiece surface being honed and means to move the work engaging member on the mandrel into engagement with the workpiece surface including means to maintain the work engaging member engaged under pressure with the work surface during honing thereof, and means to sense when a predetermined condition of the workpiece surface has been reached including means to end the honing operation, the improvement comprising means to select between automatic and manual operation of the honing machine, said means including means operatively connected to the means to move the work engaging member on the mandrel into engagement with the surface to be honed, said means including a cam follower member operatively connected to the work engaging member and a cam engageable by the cam follower member for movement thereof during an operating cycle, said cam having a contour shape to control movements of the cam follower member and movements of the work engaging member operatively connected thereto, motor means operatively connected to the cam, and means to control the motor means to control movement of the cam during an operating cycle thereof.

8. In the honing machine of claim 7 the motor means include means to cause the cam means to rotate through approximately 360° during each cycle of operation.

9. In the honing machine of claim 7 mounting means on the motor means for the cam, said cam and said cam mounting means having engageable portions which are cooperatively engageable only when the cam is in a predetermined position on the mounting means.

10. In the honing machine of claim 9, the cam has a slot formed therein which cooperatively engages means on the cam mounting means in one position only of the cam thereon.

11. In the honing machine of claim 7, a manual control member mounted on the honing machine, said manual control member having a first operative connection to the cam follower member and a second operative connection to the work engaging member, operation of said manual control member simultaneously moving the cam follower member out of engagement with the cam and the work engaging members into engagement with the work surface.

12. In the honing machine of claim 7, the cam has a surface including a first portion of predetermined contour engageable by the cam follower member during the first portion of an operating cycle to control the rate of movement of the work engaging member into engagement with the work surface and a second portion of a different contour which enables the cam follower member to move to a position in which the work engaging member can move out of engagement with the work surface when the predetermined honed condition of the work surface has been sensed.

* * * * *